United States Patent [19]

Vernon

[11] 4,373,562

[45] Feb. 15, 1983

[54] SPLINE JOINTS AND METHOD AND APPARATUS FOR MAKING SAME

[76] Inventor: Joseph O. Vernon, 209 Lyons Ave., Tazewell, Va. 26451

[21] Appl. No.: 215,315

[22] Filed: Dec. 11, 1980

Related U.S. Application Data

[63] Continuation-in-part of Ser. No. 198,072, Oct. 17, 1980, abandoned.

[51] Int. Cl.[3] ..... B27C 5/10

[52] U.S. Cl. ..... 144/144.5 R; 409/130; 409/182

[58] Field of Search ..... 409/130, 182; 144/144.5, 144 R, 323, 326, 134 D, 136 C

[56] References Cited

U.S. PATENT DOCUMENTS

| | | | |
|---|---|---|---|
| 3,109,466 | 11/1963 | Jones | 144/144.5 |
| 3,878,875 | 4/1975 | McCord, Jr. | 144/144.5 |
| 4,074,736 | 2/1978 | Wolff | 144/144.5 |

FOREIGN PATENT DOCUMENTS

| | | | |
|---|---|---|---|
| 2069405 | 8/1981 | United Kingdom | 144/144.5 |

*Primary Examiner*—W. D. Bray

*Attorney, Agent, or Firm*—Bernard, Rothwell & Brown

[57] ABSTRACT

The disclosure relates to a joint fastening two slats on boards of wood perpendicularly to one another and the method and apparatus for making that joint. Abutting ends of wood bevelled at 45° angles to one another are locked in place by a bevelled wood spline which fits into dovetail grooves cut by a router through the slates. The jig for cutting the dovetail grooves includes a slotted template and a clamping apparatus for holding the wood at an angle to the template. A router is guided by the template to make the appropriate grooves which receive the spline. Another portion of the jig includes a slotted template which guides the router for bevelling the spline.

10 Claims, 10 Drawing Figures

FIG. 1
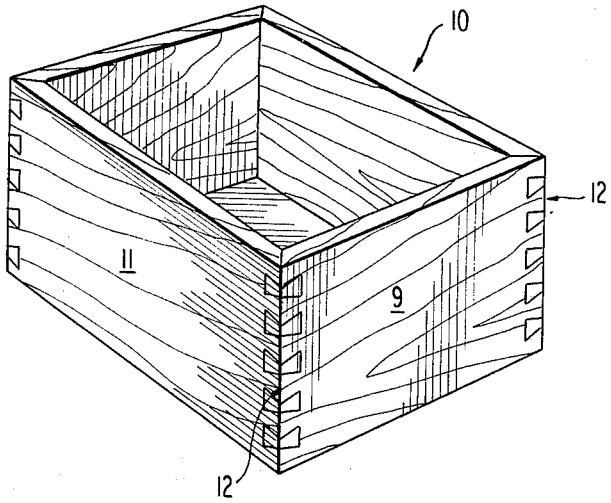
FIG. 2
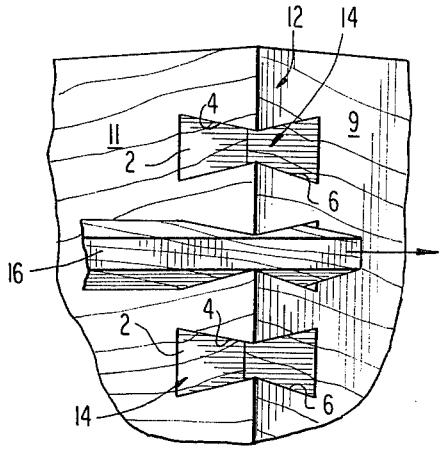
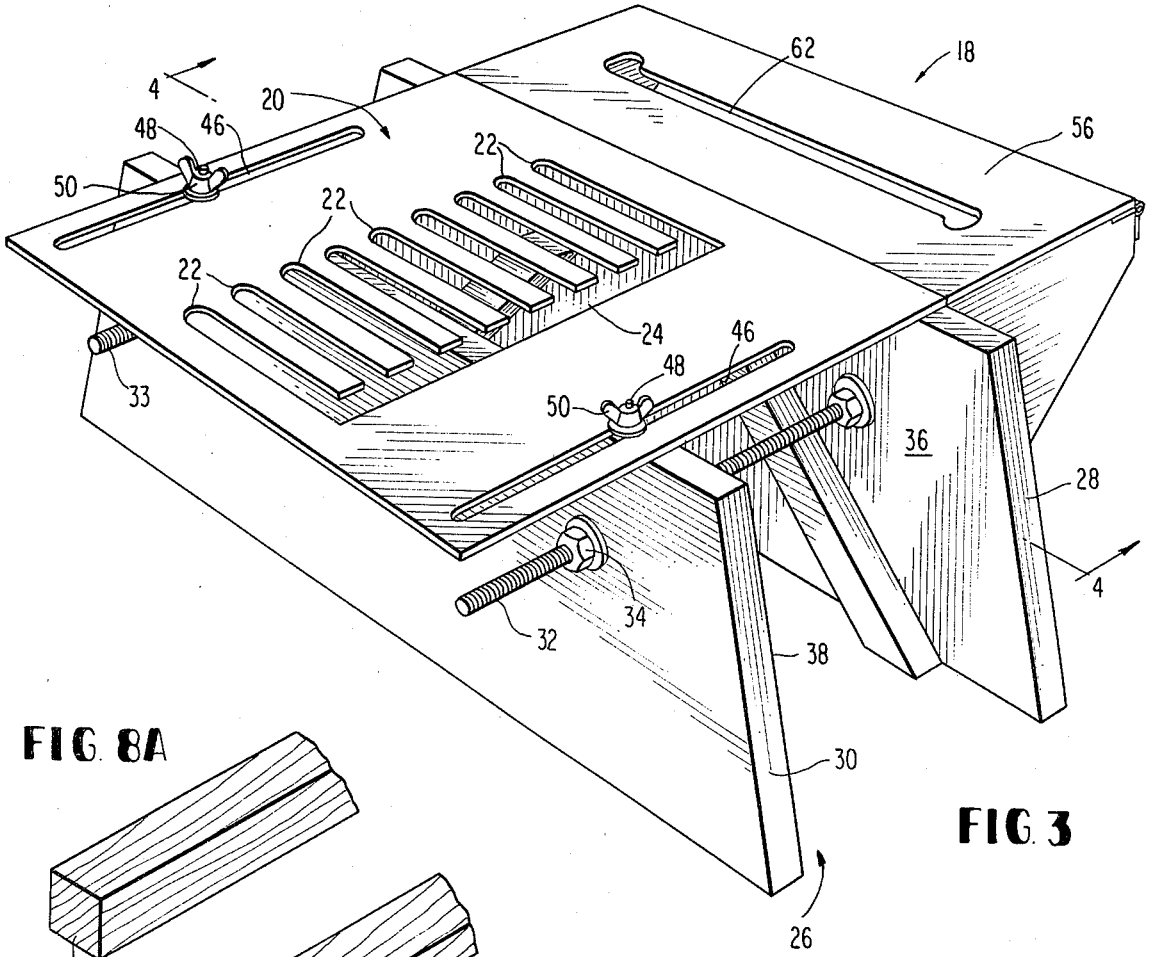
FIG. 3
FIG. 8A
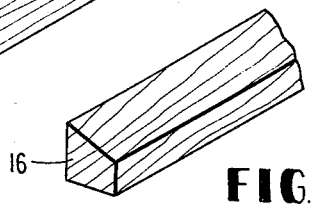
FIG. 8B

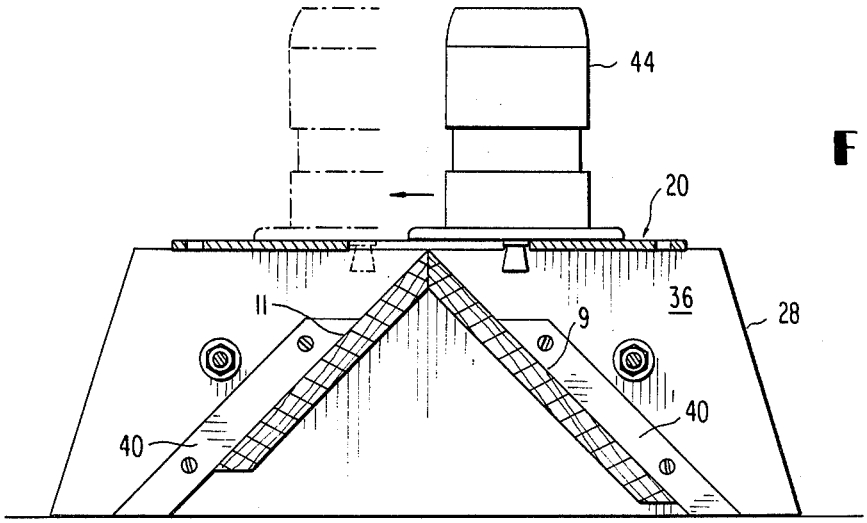
FIG. 4
FIG. 5
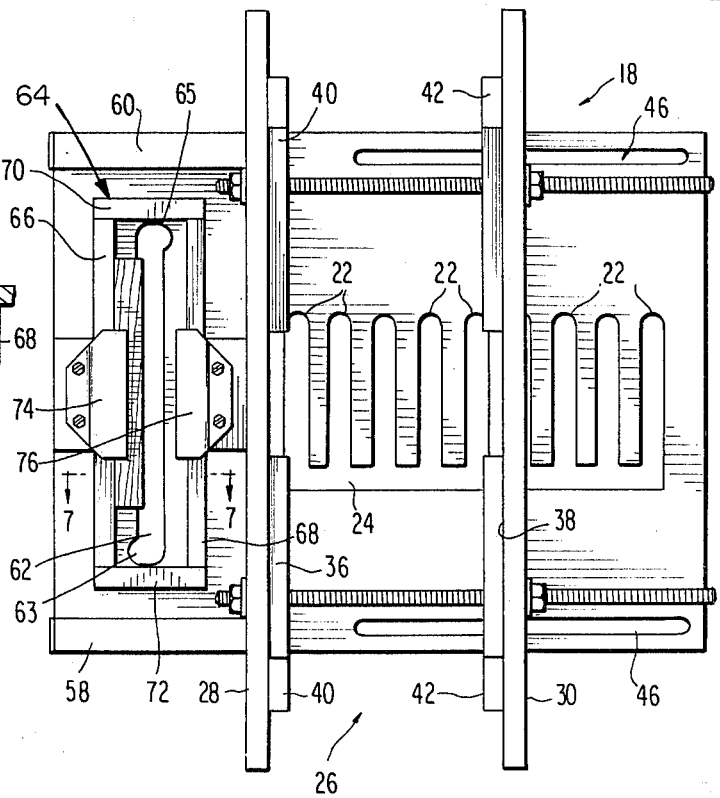
FIG. 7
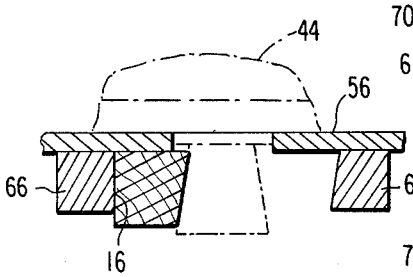
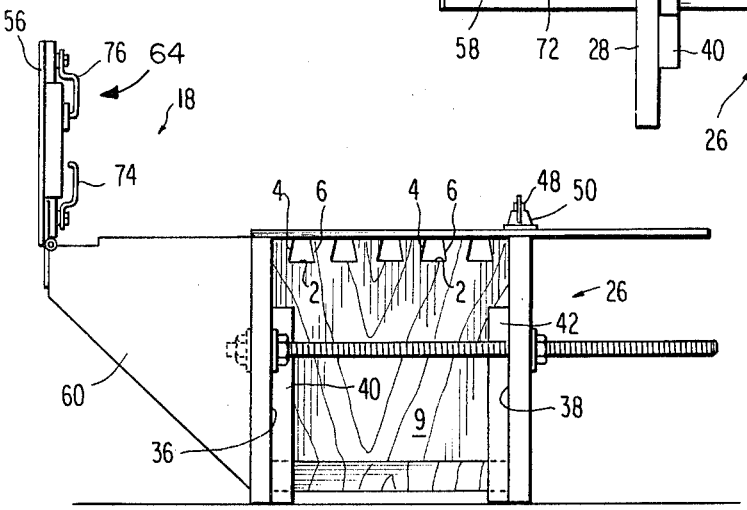
FIG. 6

SPLINE JOINTS AND METHOD AND APPARATUS FOR MAKING SAME

This application is a continuation-in-part of my earlier application Ser. No. 198,072, filed Oct. 17, 1980, and now abandoned.

BACKGROUND AND DISCUSSION OF THE INVENTION

Dovetail joints for joining perpendicularly disposed wooden slats are well known in the furniture construction industry and have commonly been used in the formation of furniture drawers, small boxes and the like. The dovetail joints are characterized by the inter-action of male and female members formed on complementary portions of the wooden members or slate which are ultimately engaged with one another typically at right angles. In one of the slats the dovetail slot or series of slots are formed perpendicular to the major axis of the slat. The dovetail is formed by a router which imparts to the slot a relatively flat bottom surface with two opposed side surfaces converging inwardly therefrom toward one another and open at the top. The complementary slat includes pins extending from the end of the slat and parallel to the major axis having surfaces parallel to those of the dovetail so that it can be slid into place with the pins extending into the corresponding slot formed by the router. This provides a joint for securing one slat at right angles to the other. An example of such a typical dovetail joint is shown in U.S. patent to Keller, U.S. Pat. No. 4,168,730 along with a jig or template used for forming these elements.

The invention described herein relates to an entirely different joint in the sense that the complementary slats which form a drawer or box do not employ male and female or tongue and groove parts for the jointed slats as shown, for example, in the Keller patent discussed above. Rather the slats are initially bevelled at a convenient angle, at 45° angle where the slats are to extend at right angles to one another, with the dovetail joints being formed at a corresponding angle through both of the abutting slats forming the joints such that the dovetail grooves register with one another. In this manner the grooves formed extend entirely through both slats where they abut one another along the bevelled surface. Subsequently, a spline having complementary surfaces parallel to those surfaces defining the dovetail grooves is placed in the groove of the two abutting members. Portions of the spline extending beyond the groove are finished to form ends coextensive with the exposed surfaces of the slats comprising the joint. With this type of joint the slats can only be disengaged by initially moving the spline members placed in the registered dovetail grooves. As a result, the joint formed is much more stable and secure since it cannot be separated by the normal movements right angles to which such joints are typically subjected particularly for such items as drawers and boxes.

The invention also relates to the jig apparatus used for forming such a joint. The jig includes a mechanism for holding two slats in place adjacent the template with the bevelled surfaces in abutting relationship. A series of slots formed in the template can guide a router used for making the series of dovetail grooves in the two abutting slats. The mechanism includes adjustments to accommodate the various size slats. Also secured to the jig is another template for forming the bevelled spline which fits within the dovetail grooves of the joint. This latter template is hingedly secured to brackets on the jig allowing the template to be pivoted upward. Located on the underside of the template is a mechanism for holding the spline to be bevelled in the proper position adjacent an elongated slot guiding. Once the spline is in place, the router can be moved along the path defined by the slot to cut the bevel into the spline.

The above joint as well as the jig for preparing the joint has particular use for a carpenter or craftsman in the amateur precision woodworking field using hand held power tools for forming joints of furniture of substantial size such as chests, cabinets and the like. However, both the joint as well as the jig for making the joint can be employed in large scale commercial operations. Other features of the invention will become apparent from the detailed discussion of the preferred embodiment which follows.

BRIEF DESCRIPTION OF THE DRAWINGS

FIG. 1 shows a perspective view of a box having a joint of the invention.

FIG. 2 is a perspective view of an enlarged portion of the joint shown in FIG. 1.

FIG. 3 is a perspective view of a jig for forming the joint of the invention.

FIG. 4 is a cross sectional view of the jig of FIG. 3 taking along lines 4—4 with a router in place on the template.

FIG. 5 is a bottom view of the jig of the invention.

FIG. 6 is a front view of the jig of FIG. 5 with the template for forming the bevelled spline in a raised position.

FIG. 7 is a cross section of a portion of the jig for forming the bevel on the spline taken along lines 7—7 of FIG. 5.

FIG. 8A is a perspective view of an unbevelled spline.

FIG. 8B is a perspective view of a bevelled spline.

DETAILED DISCUSSION OF THE PREFERRED EMBODIMENT

Figure 9:
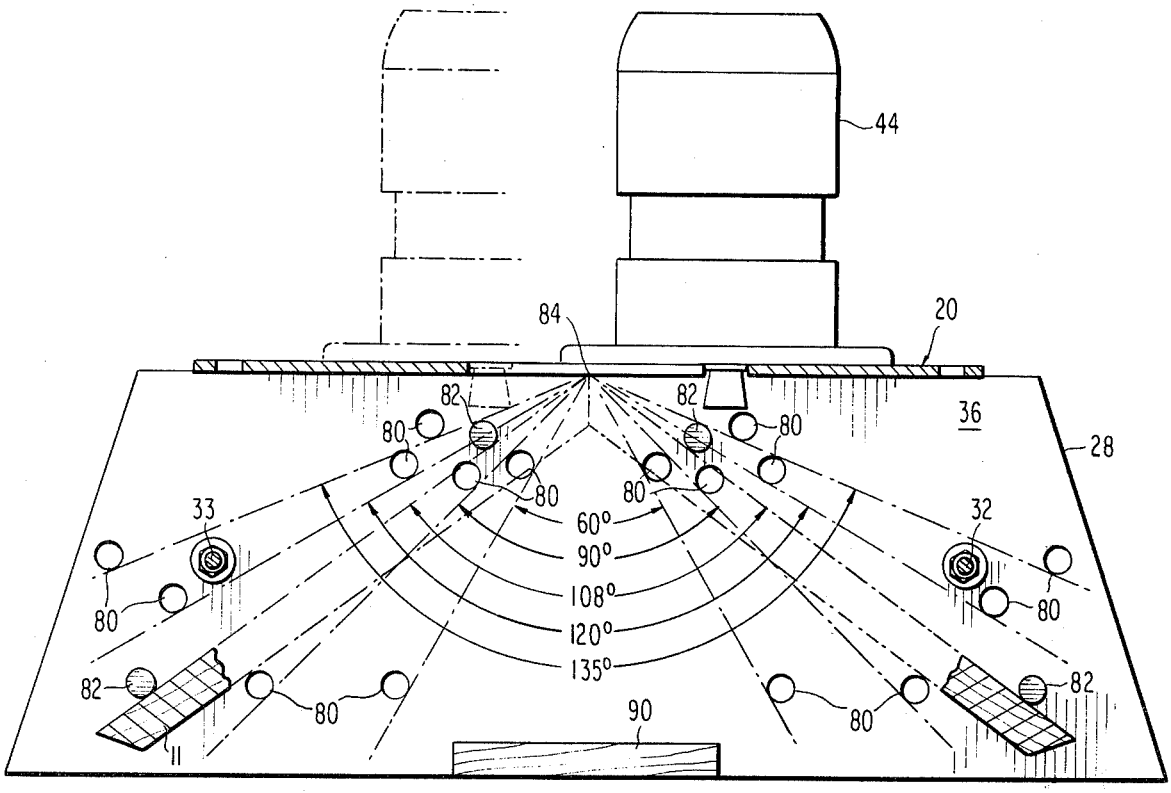
FIG. 9 is a cross sectional view of another embodiment of the jug in FIG. 3 taken along lines 4—4 with a router in place on the template.

A box, as shown in FIG. 1, having four sides in perpendicular arrangement to one another employs the dovetail and spline joint of the invention at each of the four joints used in securing the various wooden sides or slats together.

As can be seen more clearly in FIG. 2, the joint 12 of the invention used at each one of the joints for the box 10 as shown in FIG. 1 includes a dovetail slot 14 with a bevelled spline 16 extending through each slot at a 45° angle to the sides of the slats 9 and 11 used in forming the box. The dovetail groove or slot 14, whose cross section can be seen more clearly in FIG. 6, includes a bottom surface 2 formed at a 45° angle to the side of the slats. The sides 4 and 6 of dovetail slot 14 are in converging relationship, and in this embodiment are 12° to the horizontal, although other convenient angles may be used. The top of slot 14 remains open, and in this configuration the slot has the cross section configuration of a trapezoid. The spline 16 has sides bevelled as can be seen in FIG. 8B to conform to the sides of dovetail slot 14 such that the bevels are also each at 12° and the bottom surface of the spline corresponds in width to that of the dovetail groove.

In forming the joint the slats are initially bevelled 45° angles, and subsequently dovetail grooves 14 are formed in the slats 9 and 11 such that when the slats are placed in an abuttimg relationship as shown in FIG. 1 complementary dovetail grooves will register with one another to form a continuous slot through both the slats 9 and 11 at joint 12. Bottom surface 2 will be formed at a 45° angle to the slats 9 and 11 as explained above such that the entire groove or slot 14 is also at a 45° angle to the slats 9 and 11 as explained above such that the entire groove or slot 14 is also at a 45° angle to the slats 9 and 11. Bevelled spline 16 is formed by taking a square or rectangular block and bevelling the sides such that they correspond to the surfaces defining slot 14 in joint 12. Once bevelled the spline 16 is then inserted into a groove as shown in FIG. 2 and subsequently cut by a band saw or other convenient sawing means such that the ends of spline 16 will then be coextensive with the surfaces of slats 9 and 11, as can be seen in FIG. 1.

With this configuration, a much more secure joint is formed than typical tongue and groove dovetail joints which existed theretofore. This results from the angle of the registered dovetail grooves to the surface of the slats used in forming the joint. The interaction of the spline with the dovetail groove prevents the slats from being moved at right angles to one another to disengage the joint. Rather, the only way the joints can be separated is after first removing the spline by using a tool and sliding the spline out of engagement through the path at the 45° angle defined by the slot. Only after the splines have been removed in this manner can various slats be disengaged if it is so desired.

Referring to FIG. 3, there is shown a jig 18 for forming the joint described above in connection with FIGS. 1 and 2. The jig 18 includes a template 20 which is a dovetail template for forming the dovetail slots at the 45° angle shown in the slats 9 and 11 used to form joint 12. This dovetail template includes a plurality of slots 22 parallel to one another equally spaced for guiding router 21 along a path for forming each dovetail groove 14. A connecting slot 24 connects all the parallel slots 22 so that once the router has completed its path in one of the slots it can be moved readily to an adjacent slot for forming another dovetail groove.

For holding slats 9 and 11 in place beneath the template so that the bevelled ends of the slats can be cut by the router, a clamping mechanism 26 is employed. This mechanism includes a first stationary block 28 and a second moveable block 30 between which the slats 9 and 11 are held in the proper disposition with abutting bevelled surfaces adjacent the template. Two threaded rods 32 and 33 extend perpendicularly from an inner surface 36 of block 28. These rods extend through holes in the moveable block 30 and have threaded adjusting nuts 34 on the outside of the moveable block 28 to lock or tighten the moveable block down against the slats 9 and 11 once they are placed between the two blocks.

Inner facing surfaces 36, 38 respectively for first block 28 and moveable block 30 carry guide members 40 and 42 which provide a guide to locate the slats in the proper position between or in the clamping mechanism. In this embodiment the guide blocks are at 45° angle to the horizontal since the bevelled surfaces are at 45°. When placed in abutting relationship beneath the template, the bevelled surfaces will abut one another with the slats being at right angles. This can be better seen in FIG. 4.

To locate the slats at a variety of angles to the horizontal, the type of guide members illustrated in FIG. 9 are provided on the inner face of the stationary block 28 and movable block 30. Referring to FIG. 9, holes 80 are drilled through the stationary block 28 and movable block 30 to accommodate appropriately sized dowels 82. Pairs of holes are positioned along various lines extending radially from the center 84 of the template 20 where the template joins the stationary member 28. These lines correspond to the angles desired for the slats when forming the joint. Dowels 82 placed in the holes 80 provide a means for locating slat 9, 11 in the proper position between or in the clamping mechanism. Two dowels are used, in this embodiment, to locate each slat. When placed in the abutting relationship beneath the template, the bevelled surfaces will abut one another with the slats being located at the chosen angle by contact with the dowels. The slats 9 and 11 are finally held in place when the moveable block 30 is tightened. The radials are identified on the face of the blocks 28 and 30 themselves to facilitate easy selection of the available alternatives.

The angles formed by the paired holes in FIG. 9 are 60°, 90°, 108°, 120° and 135° for forming, respectively, the angle needed for an equilateral triangle, a square, a pentagon, a hexagon and an octagon. To stabilize the jig when the slats are located to form an angle of 135°, shelf members 90 are provided on the inner surface of the stationary block and the inner surface of the moveable block. The shelf members 90 support an appropriately sized spacer (not shown) which separate the moveable block 30 from the stationary block 28 when the adjusting nuts 34 are tightened on the outside of the moveable block.

As illustrated in FIG. 9, the threaded rods 32, 33 may interfere with the relatively large slats 9, 11 when the slats are located to form an angle of 135°. It should be understood that the positions of the threaded rods 32, 33 may be changed to avoid such interference at 135° or at any other angle.

For holding the template in place, once the adjusting block has been moved and locked into the proper position there are provided in the template two lateral adjusting slots 46. Template adjusting screws 48 extend upwardly from the moveable block 30 through the slots 46. Wing nuts 50 are used to tighten the template 20 and fix the template 20 to the moveable block 30 once it has been drawn down to the proper position relative to stationary block 28.

Hingedly secured to two brackets 58 and 60 extending parallel to one another and spaced apart relationship from stationary block 28 is spline template 56. The underside of spline template 56 as can be seen in FIGS. 5, 6 and 7 includes a mechanism for holding the unbevelled spline in place adjacent to slot 62 for forming a bevel such that the spline can be used in connection with the joints described above. For this purpose the slot 62 includes offsets 63 and 65 in opposite directions. It is necessary to provide offsets in opposite directions so that on a given side of the spline the router can be provided easy access to the slot for cutting the bevel.

A holding mechanism 64 includes two guide blocks 66 and 68 spaced from one another and parallel to the slot for providing a locating surface to locate the unbevelled spline so that a portion of the spline is exposed to the slot for cutting by the router. The inner side surface of the guide block 68 is bevelled for engaging a bevelled side of the spline 16. At each end of the slot and guide blocks 66 and 68 are located end blocks 70, 72 for locating and positioning the unbevelled spline along the length. The need for locating in this manner both laterally and along the length of the slot is to avoid movement of the spline which would otherwise result from the force imparted to the spline by movement of the router along the slot. The direction of movement will create a force tending to move the spline longitudinally and parallel to the length of the slot as well as laterally thereto. Therefore, both the guide blocks 66 and 68 as well as the end blocks 70 and 72 hold the spline in the proper position relative to slot 62 during movement of the router through the path defined by the slot.

In addition, for holding the spline in the proper position there are biased plates 74, 76 which provide a sufficient bias to press the splines into the under surface of a spline forming template 56 adjacent the guide blocks and end blocks. In operation the plates are simply peeled open to provide sufficient clearance so that the spline can be pressed into place adjacent the guide block and end blocks. Once in place the plates are simply released and the bias of the plates will hold the spline in the desired position as shown in FIG. 5.

In operation the slats or wood members to be used in forming the box or other member of a joint are initially bevelled at the desired angle at their ends. The bevelled slats are then placed in abutting relationship to one another with the end of each slat located in contiguous relationship with the slots 22 on the underside of dovetail template 20. For locating these slats in the proper relationship, in the embodiment of this invention illustrated in FIG. 4, they are pressed against the guide members 40, 42 on each of the stationary and moveable blocks 28 and 30 respectively. To locate the slats at any of a variety of angles, including 45°, reference is made to FIG. 10, wherein the slats are pressed against dowels 82 positioned in the appropriate holes 80 in the inner surfaces 36 of the stationary block 28.

Once the slats are located at the selected angle by pressing against the guide members 40, 42 or against the dowels 82, the adjusting nuts on the theaded rods are threaded down to tighten the moveable block against the slats aligned with the guide members 40 and 42, or the dowels 82, and hold them in place for the cutting operation. Once they have been sufficiently tightened the template is then tightened down by adjusting the wing nuts 50 on top of the template and on the template adjusting screws or bolts 48 extending upwardly for that purpose from the moveable block 30. As can be seen in FIG. 4, the router is initially placed in lateral slot 24 and then moved into one of the slots for forming the dovetail groove in both of the slats. After a groove has been formed, the router is then returned to its original position in the lateral slot and indexed downwardly to the net slot for another forming operation. The router is again moved through this adjacent slot to form another dovetail groove. This operation is repeated until all of the grooves have been formed corresponding to each one of the slots 22 in the template between the blocks 28 and 30.

Once this operation has been completed the adjusting nuts are then unscrewed to allow the moveable block 30 to be removed sufficiently from the stationary block so that the slats can be removed.

In forming the bevelled spline the unfinished or unbevelled spline is shown in FIG. 8A is initially pressed into a proper position adjacent the slot 62 and aligned against the guide block 66 and end block 70. This is accomplished by opening a biased plate 74 and inserting the block underneath and then releasing plate 74 to grasp and hold the spline and in place. Router 44 is then inserted into the offset portion 63 of slot 62 at the opposite end of end block 70 or adjacent end block 72 and then moved down the entire length of the slot for forming the bevel as shown in FIG. 8B. After this firsrt bevelling operation is completed, plate 74 is opened again, the half bevelled spline 16 is then moved to the opposite side of slot 62 adjacent block 68 but located against end block 72. Plate 76 is then received and the spline is located in proper position for the next bevelling operation. By locating the spline in this manner, the other offset portions 65 is exposed for access by router 44. Router 44 is inserted in offset portion 65 and moved through the entire length of slot 62 to bevel the other side of the spline in a similar fashion as the bevelling operation discussed in the first bevelling step. In this manner, spline 16 has bevelled surfaces corresponding to the surfaces of the dovetail groove formed in the slat. Once the bevelling is completed the bevelled spline is removed by opening the plate and simply pulling the spline from underneath the underside of the template.

In preparing the joint, the groove surfaces are placed in an abutting relationship with the grooves registering with one another as shown in FIG. 2. A spline 16 or a series of splines 16 are then inserted as shown and the ends cut such that the ends of the spline remaining in the groove are coextensive with the surfaces of the slats. In this manner the joint is made and formed to form the spline and dovetail groove joint of the invention.

I claim:

1. An apparatus for forming a joint between two flat members having bevelled ends in abutting relationship comprising:

(a) a groove forming template having slot means for guiding a router through a path;

(b) a stationary member and adjustable member moveable relative to said stationary member, said groove forming template being fixed to said stationary member;

(c) said stationary member and said adjustable member having opposed inner faces with guide means for locating flat members at an angle to the underside of said template, with an end of a flat member sufficiently adajcent said template to permit a router to cut a groove through the ends when said router is moved through said slot means; and (d) securing means for securing a flat member between said moveable member and said stationary member and positioned against said guide means and in a plate substantially perpendicular to said inner faces.

2. The apparatus according to claim 1 wherein said guide means includes means for locating at least two flat members simultaneously with the bevelled ends in abutting relationship.

3. The apparatus according to claim 2 wherein said securing means includes threaded rod means extending from said stationary member and through said adjustable member, said adjustable member being moveable toward and away from said stationary member in said rod means, threaded nut means for threaded engagement with said rod means for securing said adjustable member against a flat member located between said moveable and said adjustable members.

4. The apparatus according to claims 1, 2 or 3 wherein said guide means include guide blocks for locating flat members at about 45° angle to said template.

5. The apparatus according to claims 1, 2 or 3, wherein a spline forming template is secured to said stationary member, said spline forming template having an elongated slot for guiding a router along the path defined by said slot, and means for holding a spline adjacent said slot to permit bevelling of said spline by a router.

6. An apparatus for forming a joint between two flat members having bevelled ends in abutting relationship comprising:

(a) a groove forming template having slot means for guiding a router through a path;

(b) a stationary member and adjustable member moveable relative to said stationary member, said groove forming template being fixed to said stationary member;

(c) said stationary member and said adjustable member having opposed inner faces with guide means for locating flat members at an angle to the underside of said template, with an end of a flat member sufficiently adjacent said template to permit a router to cut a groove through the end when said router is moved through said slot means;

(d) said guide means includes adjustable means for locating said flat member among a plurality of angles relative to the underside of said template; and (e) securing means for securing a flat member between said moveable member and said stationary member and positioned against said guide means and in a plane substantially perpendicular to said inner faces.

7. The apparatus according to claim 6 wherein said guide means includes means for locating at least two flat members simultaneously with the bevelled ends in abutting relationship.

8. The apparatus according to claims 6 or 7 wherein said guide means include a plurality of holes in the inner face of at least one of said stationary member and said moveable member; said holes positioned along lines extending radially from the center of said template corresponding to various angles; and locating means removably secured within said holes for locating flat members at various angles to said template.

9. The apparatus according to claim 8 wherein said plurality of holes includes a pair of spaced apart holes along each line and said locating means including at least four dowels wherein two dowels locate a first flat member along a first line and two dowels locate a second flat member along another line complementary to said first line to form an angle between the first and second flat members.

10. The apparatus according to claim 9 wherein both moveable member and the stationary member include said lines and said holes for receiving respective sets of dowels and 4 dowels are provided for each member, said lines of one member being complementary to the lines of another for locaating the flat members among the various angles.

* * * * *